US005598944A

United States Patent [19]

Aragona

[11] Patent Number: 5,598,944

[45] Date of Patent: Feb. 4, 1997

[54] SINGLE HAND USE FOOD TRAY

[76] Inventor: James Aragona, 4 Maywood Ct., North Caldwell, N.J. 07076

[21] Appl. No.: 422,887

[22] Filed: Apr. 17, 1995

[51] Int. Cl.[6] ..... B65D 21/032

[52] U.S. Cl. ..... 220/575; 220/914; 220/556; 220/23.8; 206/518

[58] Field of Search ..... 206/515, 518, 206/519; 220/23.8, 23.83, 23.86, 914, 575, 556

[56] References Cited

U.S. PATENT DOCUMENTS

| | | | |
|---|---|---|---|
| 255,726 | 3/1882 | David | 220/23.8 |
| 421,264 | 2/1890 | Gibbons | 220/575 |
| 1,321,145 | 11/1919 | Price | 220/23.8 |
| 1,544,972 | 7/1925 | Gebelein | 220/23.8 |
| 1,885,483 | 11/1932 | Samuelson | 220/23.83 |
| 2,700,284 | 1/1955 | Lyon, Jr. | 220/23.8 |
| 4,966,297 | 10/1992 | Doty . | |
| 5,294,000 | 3/1994 | Yanuzzi | 220/914 |

FOREIGN PATENT DOCUMENTS

| | | | |
|---|---|---|---|
| 16713 | 3/1893 | United Kingdom | 220/23.8 |
| 255643 | 7/1926 | United Kingdom | 220/23.8 |
| 2118430 | 11/1983 | United Kingdom | 220/575 |

*Primary Examiner*—Stephen J. Castellano
*Attorney, Agent, or Firm*—McGlew and Tuttle

[57] ABSTRACT

The present invention is a food tray wherein a portion of the food tray is molded into a food bowl for holding the food. The food bowl includes a food bowl base, a food bowl wall extending away from the food bowl base, and a food bowl rim positioned on an opposite side of the food bowl wall from the food bowl base. A grip is provided on the tray, and connected and positioned with respect to the food bowl wall for providing a grip to the hand of the user. The grip provides a grip with the thumb gripping on one side of the tray and all other fingers of the hand being able to spread or fan out to grip on an under side of the tray opposite the one side. The grip includes a thumb grip edge which is preferably placed at the inside base of the thumb. The present invention also has a palm extension which is connected to the grip and fits into the palm of the hand that is holding the tray. The palm extension has a palm extension edge which extends into the palm of the user for support. The palm extension edge merges on one end with the thumb grip edge of the grip and where these two edges merge, they form a concave curve.

8 Claims, 5 Drawing Sheets

SINGLE HAND USE FOOD TRAY

FIELD OF THE INVENTION

The present invention relates to a food tray constructed as a single unit, which has structure to facilitate carrying the tray in one hand. The tray has a specialized design for the hand grip along with a molded contour for a cup and for simple nested stacking of multiple trays. The material of the tray can be plastic, paper, metal, or any material that can be fashioned into a similar unit.

BACKGROUND OF THE INVENTION

Small food trays or common plates are often used in many common situations where food and/or drink can not be placed on a support such as a table. The user carries a tray in one hand while leaving the other hand entirely free. One common situation is at a social function where food is being served.

A disadvantage of common plates and food trays, is they are difficult to hold steady in one hand while eating out of them in another. The reason for this is that the common plate or tray was designed to placed on a table or a flat surface and was not designed to be supported by a single hand while the other hand performs operations on the food in the tray or the plate.

U.S. Pat. No. 4,955,247 describes a tray that has a hand grip for holding the tray and a cup. The tray is designed to be held in a particular manner, as shown in FIG. 7. As one can see from the drawings, the indicated manner of using this prior art tray is with the thumb and index finger on the top, or upper surface, of the tray with the remaining fingers underneath the tray. This is not a biomechanically comfortable position for the hand and does not allow the hand/wrist/forearm unit to be rotated upward or supinated. A tray held in this manner causes fatigue to rapidly set in and discomfort to the user. Additionally the finger placement of the remaining three fingers on the under surface of the prior art tray does not allow for smooth placement of the fingers and therefore does not allow for steady support of the tray. Additionally this prior art tray does not teach or suggest any structure which could interact with the palm of the user to assist in supporting the tray.

SUMMARY AND OBJECTS OF THE INVENTION

The object of the present invention is to provide a better, more comfortable and less tiring way to hold a food tray with one hand, especially while eating out of the tray in with the other hand.

These objects are achieved with several different features. One feature is the position of the hand for carrying the tray. This present invention allows for the thumb to be placed on the top or upper surface of the tray and the remaining four fingers to be spread out under the lower surface, or bottom, of the tray. This positioning of the hand is a new concept in this field and is a correct or favorable position, according to hand biomechanics. The position of the hand allows for steady balancing of the tray. Additionally, it is a restful and stable position for the hand/wrist/forearm unit. The correct positioning will allow the forearm to be rotated into a mild palm up or supinated position which is a natural functional position for the hand/wrist biomechanical unit.

Additionally the present invention has an area, or extension, which fits into the palm portion of the hand of the user, thus allowing for additional support, especially to balance or compliment the support provided by the fingers. There are other beneficial features of the device. It has the ability to be stacked, therefore, facilitating storage and handling. There is a molded contour area for a standard size cup and an additional molded area for food service.

The material for this device is varied. Such materials as plastic, metal, paper are choices but other materials that can be molded could be applied to manufacturer of the device. Other materials could be used as desired by the user.

The present invention is a food tray wherein a portion of the food tray is molded into a food bowl means for holding the food. The food bowl means includes a food bowl base, a food bowl wall extending away from the food bowl base, and a food bowl rim positioned on an opposite side of the food bowl wall from the food bowl base. A grip means is provided on the tray, and connected and positioned with respect to the food bowl wall for providing a grip to the hand of the user. The grip means provides a grip with the thumb gripping on one side of the tray and all other fingers of the hand being able to spread or fan out to grip on an under side of the tray opposite the one side. The grip means includes a thumb grip edge which is preferably placed at the inside base of the thumb. The present invention also has a palm extension means which is connected to the grip means and fits into the palm of the hand that is holding the tray. The palm extension means has a palm extension edge which extends into the palm of the user for support. The palm extension edge merges on one end with the thumb grip edge of the grip means, and where these two edges merge, they form a concave curve.

The present invention can also include a cup holder. The cup holder can be in the form of a cup bowl with a similar base, walls and rim as the food bowl means. The cup holder means is positioned between the palm extension edge and the food bowl means in order that the food bowl means, the grip means and the palm extension can make a very efficient use of the surface area of the tray. The cup holder means has a portion which is included in the palm extension means. This is very advantageous, since the cup holder means has a portion shaped similar to the palm extension means and since the fluid in a cup often is responsible for most of the weight on a food tray, and requires the most support in order to keep it from spilling.

In the preferred embodiment, the tray contains a first and second grip means, which can be gripped by either the left hand or right hand depending on the preference of the user. These grip means are positioned on opposite sides of the palm extension, and the cup holder.

It is further an object of the present invention to provide a single user food tray which is simple in design, rugged in construction, and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
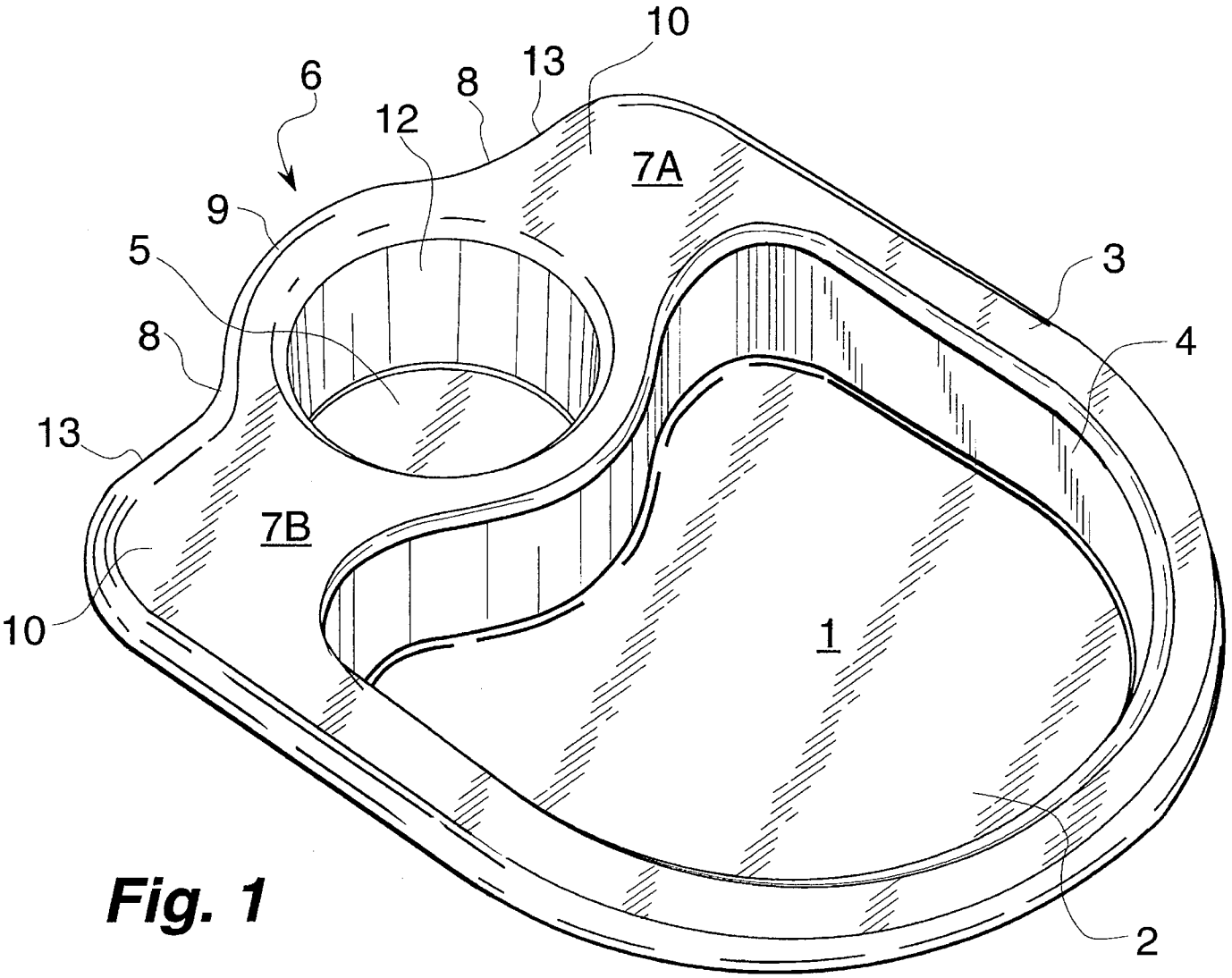
FIG. 1 is a perspective view of the food tray of the present invention.

Referring to the drawings, and in particular to FIG. 1, the food tray of the present invention contains a food bowl or food holding means 1 for containing and holding the food. The food bowl means 1 has a food bowl base 2 which is substantially planar and a food bowl wall 4 which extends in an upward direction from the food bowl base 2. On a side of the food bowl wall 4, substantially opposite the food bowl base 2, there is a food bowl rim 3 which lies in a plane spaced from, and substantially parallel to the food bowl base 2.

Figure 2:
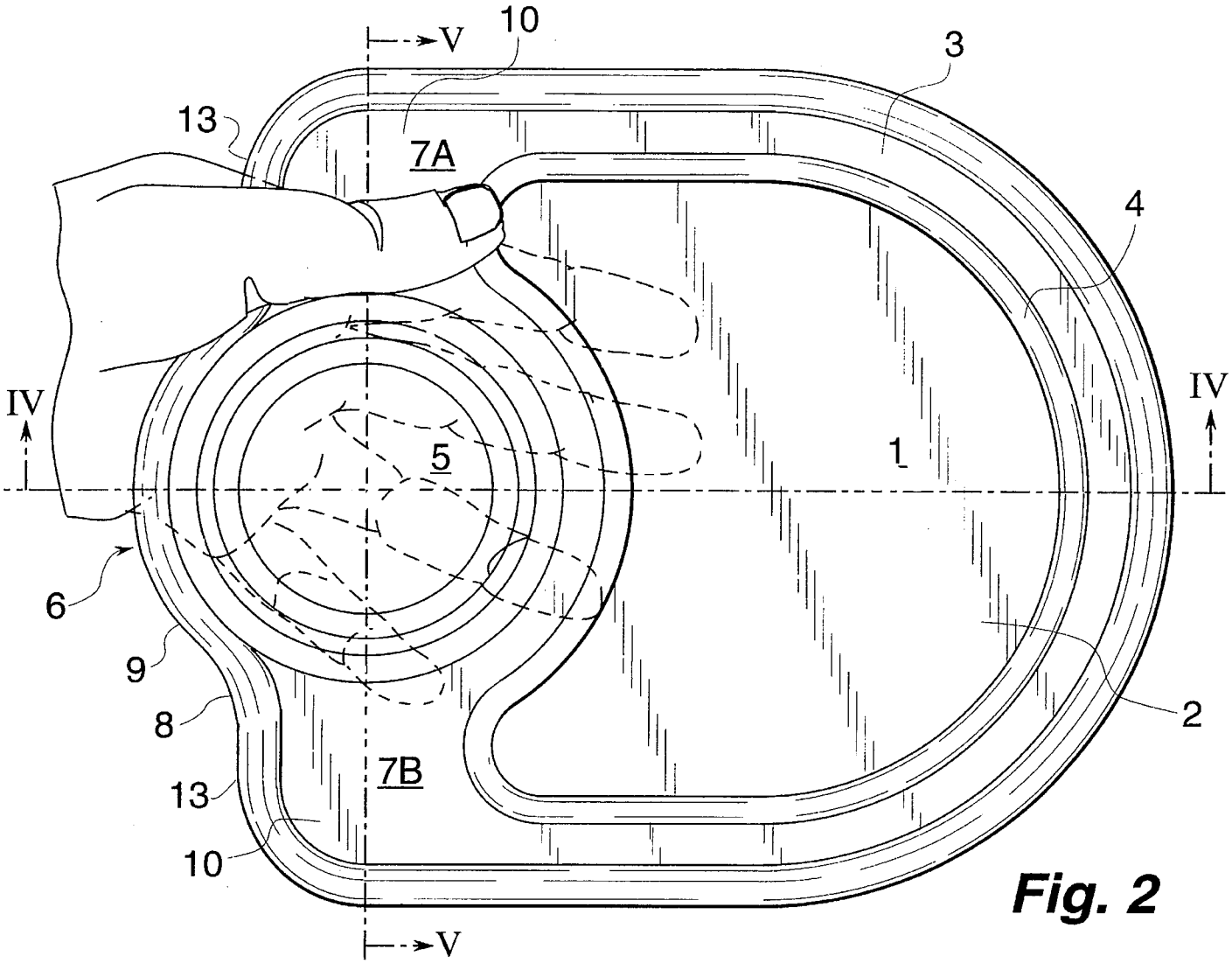
FIG. 2 is a plan view of the present invention as being held by the left hand of the user.

Positioned adjacent the food bowl means I is a cup holder means 5 for holding a cup 11. The cup 11 is positioned inside the cup holder means 5 and the cup holder means 5 has cup holder walls 12 which extend up a sufficient distance to adequately support the cup 11 during normal movements of the hand holding the tray. On opposite sides of the cup holder 5, and connected to the food bowl means 1, there are first and second, or left and right grip means 7A and 7B respectively. These grip means 7 provide an upper, or thumb grip, surface 10 to be gripped by the thumb of the hand holding the tray. In between the two grip means 7A, 7B, there is a palm extension of palm fitting means 6. This palm extension or fitting means 6 is positioned on an opposite side of the cup holder 5 from the food bowl means i and extends outward from the tray further than the two grip means 7A, 7B. In the interest of efficient use of space and due to similar shapes, the cup holder means 5 has a portion that is included in the palm extension means 6. The grip means 7 has a thumb edge 13 which is positioned to contact the inside base of the thumb when the grip means is held by the hand. The palm extension means 6 also has a palm extension edge 9 which meets with the thumb extension edge 13 of each of the grip means 7A and 7B, at opposite ends of the palm extension edge 9. The present invention is designed to have the merging of the palm extension edge with the thumb grip edge 13 be a concave curve 8 at the point of the merging to wrap around the base of the thumb as shown in FIG. 2. The palm extension means 6 and the palm extension edge 9 are also designed to have a convex shape as they protrude from the tray. The concave curve 8 between the palm extension edge 9 and the thumb grip edge 13, along with the convex shape of the palm extension means, causes the grip means to have a thumb grip surface 10 that can be gripped by the thumb of the user and a palm extension means 6 which fits into the palm of the user and causes the palm to provide support to the tray. This also causes the remaining fingers of the hand to be positioned underneath the tray and to be able to spread out and evenly support the tray with the remaining fingers.

Figure 3:
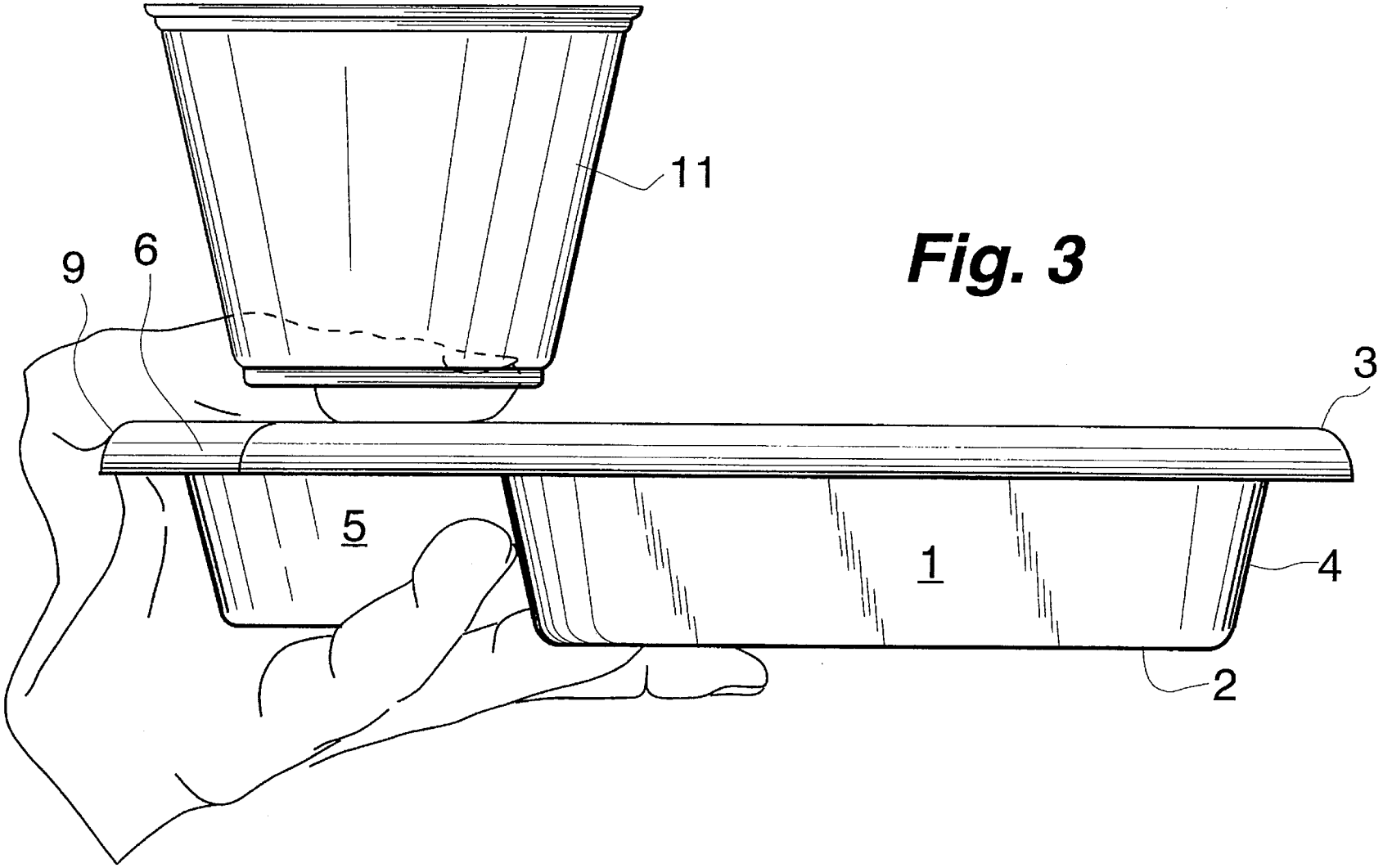
FIG. 3 is a side view of the food tray showing a palette style grip by the left hand of the user.
Figure 4:
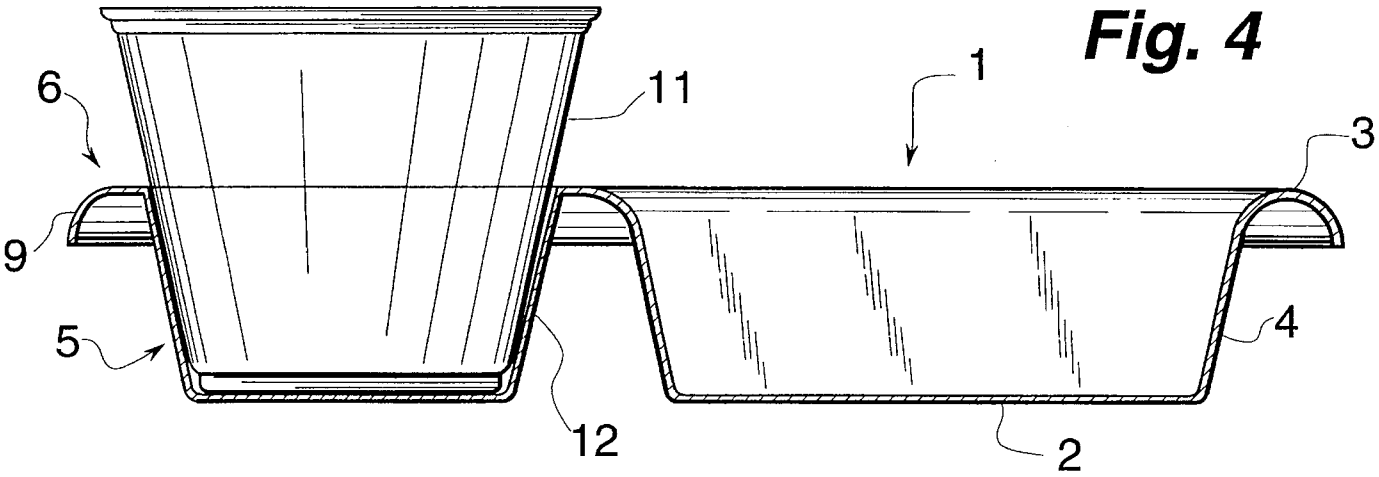
FIG. 4 is a cross sectional view along the view line IV—IV in FIG. 2.
Figure 5:
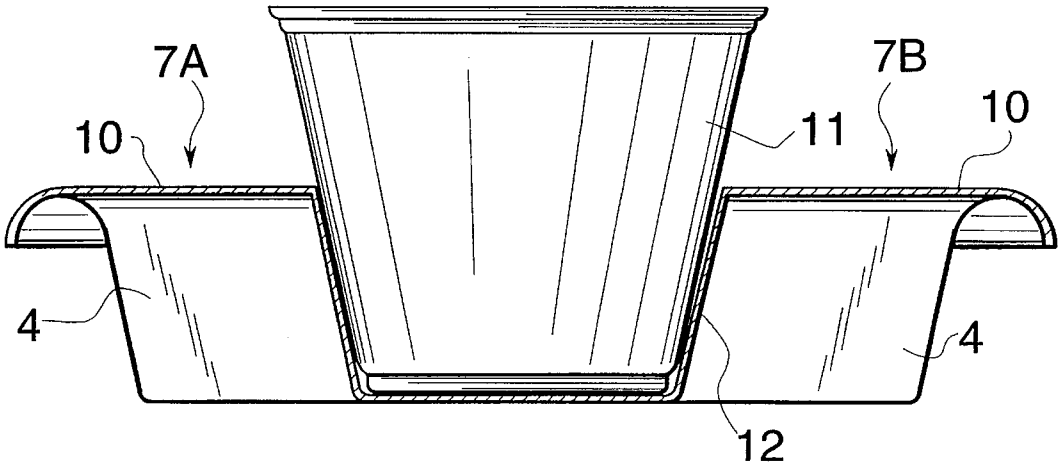
FIG. 5 is a cross sectional view along the view line V—V as shown in FIG. 2.

FIG. 2 shows the left hand of the user in the preferred position for gripping, holding and supporting the tray. As one can see, the thumb is positioned on the thumb gripping surface 10 of the grip means 7A and the thumb grip edge 13 is positioned against the inside base of the thumb. This causes the remaining fingers to be able to be positioned underneath the tray and provide support for the tray. As shown in FIGS. 2 and 3, the cup holder means 5 forms a protrusion which is graspable by the fingers of the hand holding the tray. The palm extension means 6 and the palm extension edge are fitted into the palm of the hand, as is further shown in FIG. 3. The support provided by the palm extension means 6 balances or complements the support provided by the remaining fingers of the hand. As one can also appreciate, the right hand of the user could be used, in which case the thumb would be positioned on the thumb grip surface 10 of the grip means 7B. The palm extension means 6 and the palm extension edge 9 would then also fit into the palm of the user.

Figure 6:
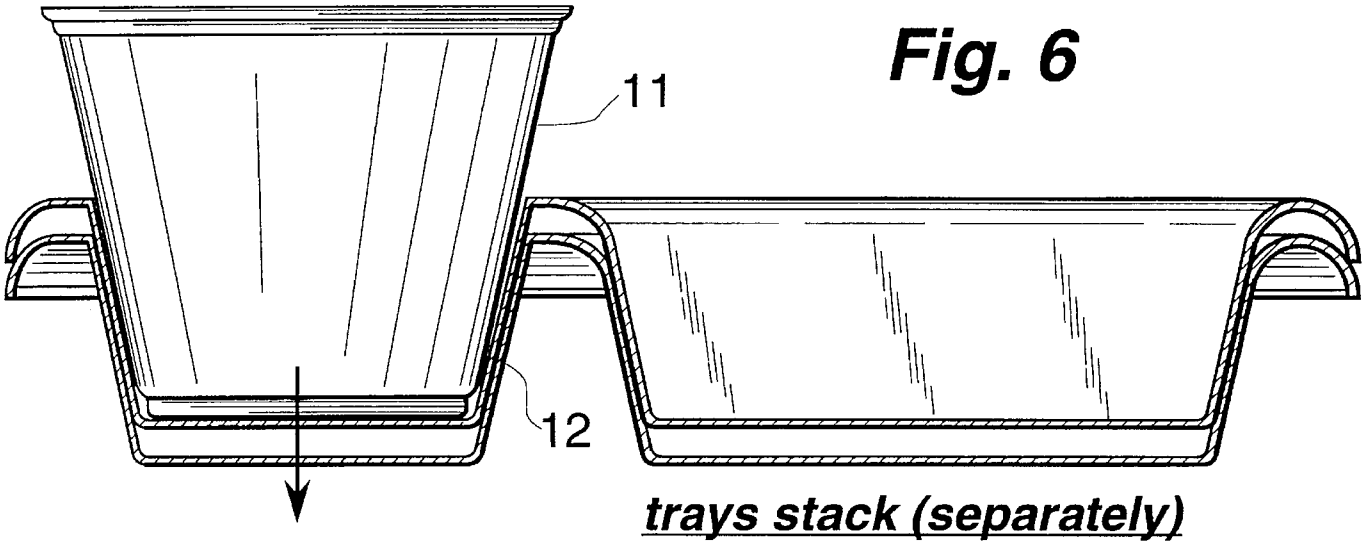
FIG. 6 shows two of the trays stacked on top of each other in a nested manner.
Figure 7:
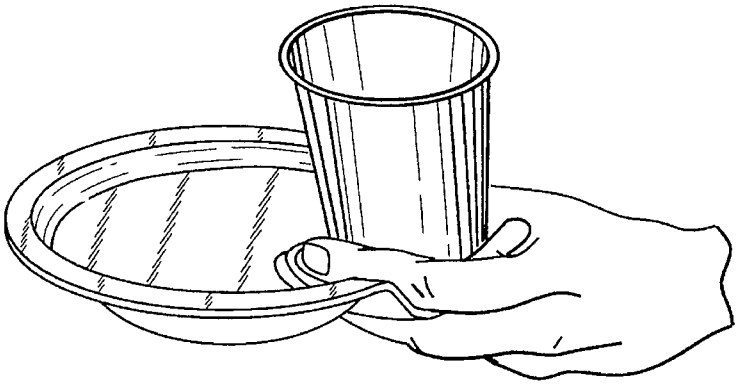
Fig. 7 (PRIOR ART)
FIG. 7 shows a prior art tray and the grip used to hold the prior art tray.

The shape of the food bowl means 1 and the cup holder means 5 is preferably shaped in a diverging upwards fashion, so that the trays may be stacked in a nested fashion as shown in FIG. 6. Also the cup holder means 5 can protrude into the food bowl means 1 to cause a bulge in the food bowl wall 4, in order to have an efficient use of the space on the tray.

While specific embodiments of the invention have been shown and described in detail to illustrate the application of the principles of the invention, it will be understood that the invention may be embodied otherwise without departing from such principles.

What is claimed is:

1. A food tray comprising:

food holding means for holding food, said food holding means including a food bowl base, lying in a food bowl base plane, a food bowl wall extending away from said food bowl base, and a food bowl rim positioned on an opposite side of said food bowl wall from said food bowl base, said food bowl rim lying in a food bowl rim plane, said food bowl base plane being parallel to said food bowl rim plane;

right hand grip means connected and positioned with respect to said food bowl wall for providing a grip to a right hand of a user with a thumb griping on one side of the tray and all other fingers of the hand griping another side of the tray, said grip means including a thumb grip edge and a thumb grip surface for gripping by the thumb of the hand to position all other fingers of the hand on said another side of the tray, said thumb grip surface being in said food bowl rim plane, said grip means being adjacent to said food bowl wall;

left hand grip means connected and positioned with respect to said food bowl wall for providing a grip to a left hand of a user with a thumb griping on one side of the tray and all other fingers of the hand griping another side of the tray, said grip means including a left thumb grip edge and a left thumb grip surface for gripping by the left thumb of the left hand to position all other fingers of the left hand on said another side of the tray, said thumb grip surface being in said food bowl rim plane, said right grip means being adjacent to said food bowl wall;

a palm fitting means connected to each of said right grip means and said left grip means for fitting into a palm of the hand of the user, said palm fitting means including a palm extension edge extending into the palm of the user, said palm extension edge merging on one end with said right thumb grip edge to form a concave curve and merging on another end with said left thumb grip edge to form another concave curve;

cup holder means for holding a cup; said cup holder means being positioned between said palm extension edge and said food holding means, said cup holder means including a cup bowl base, a cup bowl wall extending away from said cup bowl base, and a cup bowl rim positioned on an opposite side of said cup bowl wall from said cup bowl base, said cup bowl base and said cup bowl wall forming a protrusion graspable by said all other fingers of either the right hand or the left hand, on said another side of the tray, wherein the tray is supportable by either said right hand or said left hand, wherein the tray is symmetrical about a centerline passing through the centers of said food bowl base and said cup bowl base.

2. A tray in accordance with claim 1, wherein:

said cup holder means has a portion included in said palm extension fitting means.

3. A tray in accordance with claim 1, wherein:

said cup bowl base is in substantially a same plane as said food bowl base, and said cup bowl rim is in substantially a same plane as said food bowl rim.

4. A tray in accordance with claim 1, wherein:

said fitting means is convex shaped and extends further out from the tray than said grip means.

5. A tray in accordance with claim 1, wherein:

said thumb grip edge is part of an external edge of the tray which extends completely around the tray.

6. A tray in accordance with claim 1, wherein:

said food holding means and said grip means are sized to define a structure which can be supported by a single hand.

7. A tray in accordance with claim 1, wherein:

said food holding means and said cup holder means are shaped to define nesting means for stacking a plurality of the trays in a nested manner.

8. A tray in accordance with claim 1, wherein:

said concave curve formed between said palm extension edge and said thumb grip edge is shaped and positioned with respect to a remainder of the tray to wrap around a base of the thumb of the user when holding the tray with the thumb on said one side and the other fingers griping said another side of the tray.

* * * * *